US007107880B2

(12) United States Patent
Kitchen et al.

(10) Patent No.: US 7,107,880 B2
(45) Date of Patent: Sep. 19, 2006

(54) CONDUIT LOCKNUT WRENCH

(76) Inventors: Edward F. Kitchen, 259 Lower Cliff Dr., #301, Laguna Beach, CA (US) 92651; Bradley D. Kitchen, 25 Southwind, Aliso Viejo, CA (US) 92656

( * ) Notice: Subject to any disclaimer, the term of this patent is extended or adjusted under 35 U.S.C. 154(b) by 0 days.

(21) Appl. No.: 09/972,659

(22) Filed: Oct. 9, 2001

(65) Prior Publication Data

US 2003/0066394 A1 Apr. 10, 2003

(51) Int. Cl.
*B25B 13/56* (2006.01)

(52) U.S. Cl. ..... 81/176.1; 81/119

(58) Field of Classification Search ..... 81/176.15, 81/176.2, 119, 176.1; D8/17, 19, 27
See application file for complete search history.

(56) References Cited

U.S. PATENT DOCUMENTS

| | | | | | |
|---|---|---|---|---|---|
| 464,084 | A | * | 12/1891 | Robinson | 81/176.1 |
| D34,137 | S | * | 2/1901 | Mercier | D8/17 |
| D59,396 | S | * | 10/1921 | Williams | D8/17 |
| D135,845 | S | * | 6/1943 | Mayo | D8/17 |
| D138,515 | S | * | 8/1944 | Hardy | 81/176.1 |
| D138,790 | S | * | 9/1944 | Czekalski | 81/176.1 |
| 2,360,163 | A | * | 10/1944 | Sadler | 81/176.1 |
| 2,420,458 | A | * | 5/1947 | Barker | 81/176.1 |
| 2,830,480 | A | * | 4/1958 | Brame | 81/176.15 |
| D227,651 | S | * | 7/1973 | Sharff | D8/17 |
| 4,526,193 | A | * | 7/1985 | Drach | 81/176.1 |
| 5,524,511 | A | * | 6/1996 | Taka's | 81/176.15 |
| 6,058,813 | A | * | 5/2000 | Bryant et al. | 81/176.1 |
| 6,705,182 | B1 | * | 3/2004 | Bennett | 81/176.2 |
| 2003/0066394 | A1 | * | 4/2003 | Kitchen et al. | 81/176.1 |
| 2004/0055427 | A1 | * | 3/2004 | Stier | 81/119 |
| 2004/0074346 | A1 | * | 4/2004 | Schmidt | 81/176.15 |

* cited by examiner

*Primary Examiner*—Lee D. Wilson

(57) ABSTRACT

A conduit locknut wrench for use in the electrical trade and designed for tightening and loosening both six and eight tooth conduit locknuts. The conduit locknut wrench allows the electrician the ability to access hard to reach locknuts at any angle and around any obstruction including other locknuts with or without protruding wires. The small light weight wrench has very thin dimensions and includes a C-shaped head with two arcuate arms, two opposed engagement teeth, an elongated thin neck and a handle portion. The handle portion includes a screwdriver leverage hole and an oversized belt clip hole.

4 Claims, 5 Drawing Sheets

CONDUIT LOCKNUT WRENCH

CROSS-REFERENCE TO RELATED APPLICATIONS

N/A

STATEMENT REGARDING FEDERALLY SPONSORED RESEARCH DEVELOPMENT

N/A

REFERENCE TO A MICROFICHE APPENDIX

N/A

BACKGROUND OF THE INVENTION

This invention relates to the field of hand tools used or carried by an electrician. The conduit locknut wrench is more specifically used for the assembling and disassembling of electrical fittings used by the electrical industry in junction boxes, panels, device boxes etc.

For years electricians have had difficulty in tightening and loosening conduit locknuts, also called lockrings. From this point they will be referred to herein as "locknuts." Locknuts are usually found in or around junction boxes, panels, metal boxes etc. Among electricians it is common to struggle with a locknut. Typically, locknuts are positioned in places that are hard to reach within an enclosure where sharp edges and awkward angles are prevalent. To compound matters the locknut itself has a unique shape that is not easy to grip with any tool that is in use by electricians today. Currently, electricians use a variety of tools all of which are not easy to manipulate and none of which precisely match the shape of the locknut. Tightening and loosening of these locknuts is not a simple and straight forward matter. At present, often several attempts are made using a variety of tools and techniques involving thought and a specific strategy. For the electrician, this can be both time consuming and costly. The locknut is often left loose because of the difficulty in tightening. There is no tool available to help electricians with this commonly encountered task. Hence the need for the conduit locknut wrench.

Few tools have been patented in recent years for the use in modern electrical equipment. The older spanner type wrenches would not be as useful today because of recent development with use of mc cable, flood lamp sockets, PVC, smerf cable, seal tight water proof conduit and changes to the shape of the locknut itself. In addition, both Of all the patents available, none are on the shelf readily for use or purchase by electricians. The spanner wrench type prior art includes that of Gagne, Bowles, Houghton, Young, Brame, Barnes, and Hockenberry. All of the patents above were spanner type wrenches including, swivel heads, pivot heads and ratchets used for tubing unions and older electrical connectors. None of these were designed for conduit locknuts or do an adequate job on them. Of all the prior art in existence only two patents relate specifically to conduit locknuts. They are Bryant (U.S. Pat. No. 6,058,813) which relates a pivoting socket head with attached handle and Taka (U.S. Pat. No. 5,524,511) which relates a C-shaped pivoting notched head with an extended handle. The similar characteristic is that the wrenches have a shaped head which would fit over or around a locknut.

Gagne (U.S. Pat. No. 1,752,074), Houghton (U.S. Pat. No. 2,522,038), Brame (U.S. Pat. No. 2,830,480), Barnes (U.S. Pat. No. 3,768,345), Hockenbery (U.S. Pat. No. 4,848,195), and Bryant (U.S. Pat. No. 6,058,813), describe a wrenches that will not turn both six and eight tooth locknuts. Houghton (U.S. Pat. No. 2,522,038), Hockenbery (U.S. Pat. No. 4,848,195), Bryant (U.S. Pat. No. 6,058,813) Taka (U.S. Pat. No. 5,524,511), Thonet (U.S. Pat. No. 2,397,574) and Vibber (U.S. Pat. No. 1,633,297), all show multi-piece wrenches, all of which require assembly, some of which appear to be heavy and cumbersome, and also some of which call for machining to make and also which are not particularly suited for carrying in an electrician's tool belt pouch. Gagne (U.S. Pat. No. 1,752,074), Young (U.S. Pat. No. 2,575,779), Williams (U.S. D59,396) Mercier (U.S. D34,137), Sharff (U.S. D227,651), Drach (U.S. Pat. No. 4,526,193), and Bennett (U.S. Pat. No. 6,705,182 B2) all show wrenches that are not suited to turn a locknut from all angles of approach. The wrenches can be applied from the side, or at an angle, or straight in (in perpendicular fashion), but not from all angles. Some of the wrenches, if applied at a given angle, would not remain seated in gripping position while turning locknuts. Bowles (U.S. Pat. No. 2,233,046), Young (U.S. Pat. No. 2,575,779), and Vibber (U.S. Pat. No. 1,633,297) describe wrenches that are not particularly suited to engage a locknut with wires present.

The wrenches previously patented are too heavy to carry and too expensive to make for the application at hand. They are also more complex and cannot be machined, stamped or cut simply from one piece of material. The prior art indicates that the wrenches would not have ample turning leverage during the execution of a straight-in approach. Visibility of the teeth during engagement of the locknut is also very difficult. These wrenches cannot be readily or thoughtlessly inserted head first into a junction box or into an electricians tool bag. The previously patented wrenches appear to be excessively large and cumbersome comparatively relative to the size of a locknut itself. While prior claims of the ability to fit around adjacent wires may be correct, the opening for the protruding wires is not adequate because of the angle which the wires must be bent to facilitate the usage of the wrench. The previously patented wrenches all have thick heavyweight designs which could cause the user to over tighten or snap the lightly constructed locknut.

All of the prior art researched and or mentioned above have two similar problems. The first and most important problem is the size and weight. Electricians tend to carry the least amount of tools and weight possible. The reason for this is because they are either on a latter or in a crawl space and need to be able to move around easily. Therefore they carry only the lightest most useful tools and no others. They will not carry cumbersome and heavy tools regardless of how useful they may be. The second problem encountered by prior art is ease of use. With the use of socket and pivoting tool heads the locknut is not easily sighted, engaged and manipulated with ease. This problem compounds when you have multiple locknuts with protruding wires in a single junction box or panel.

While these devices might fulfill their respective objectives, the aforementioned patents do not describe a wrench that has the ability to be used in extremely tight hard to reach areas at any given angle, including protruding wires and other locknuts, which is also small enough and light enough to be carried on or in an electricians tool pouch.

BRIEF SUMMARY OF THE INVENTION

The present invention overcomes the existing problems in prior art, first and foremost, because it is a simple light weight small one piece wrench for tightening or loosening conduit locknuts and suited to be carried as part of the electricians tool ensemble. The wrenches are designed for each of the various trade sizes of locknuts. These sizes include ½", ¾", 1", 1¼", 1½", 2 and many others.

The conduit locknut wrench has a C-shaped gripping head section, a neck and a handle. The C-shaped gripping head has two adjacent diametrically opposed teeth designed to fit the recesses of both six and eight tooth conduit locknuts. This is unique because one small wrench can be used on a number of various locknuts. The small C-shaped head ratios allow one to fit the tool into extremely tight areas and grip the nut without having to realign it. The size and shape attributes contribute to the extreme lightness of the tool.

The arms of the C-shaped head are of sufficient sliminess to provide working and engagement space in the numerous circumstances where access may be difficult. This occurs when there is an adjacent locknut or a junction box tab close to the working area. The arms inner diameter is of a size to sufficiently envelope the entire locknut and to provide a certain amount of free play and allowance for locknut variations. The thinness of the arms lends itself to good visibility during engagement of the nut.

The neck is of ample hardness to be relatively thin to improve turning radius for more distantly located locknuts. The neck is also thin enough to allow the user to have plenty of feedback during engagement with the nut that a thicker heavier wrench might not provide.

The handle is suitably (disproportionately compared to other wrench type tools) wide enough to allow relative ease of leverage when approaching a locknut in a perpendicular fashion (straight in approach). This feature is extremely useful. For example, agricultural and landscape boxes are often deep and full of wires and the locknuts are usually corroded or rusted into place at the bottom of the junction box. The handle also has a hole large enough to insert a screwdriver which is used to provide additional leverage if needed. This tool can approach the conduit locknut from every angle and still open and close with ease while still providing the appropriate leverage for loosening and tightening. These applications can be done with or without wires being in the way. There is also a hole large enough to clip onto a tool belt.

The conduit locknut wrench is easy to make, easy to carry and does all the tasks well rather than one or two tasks adequately. Hence the need for only one tool. It is of a size and weight permitting it to be put inside a pouch or carried on a belt clip. The conduit locknut wrench tool has the simplicity required to bring it to market and presently no such tool is in existence. The electrician will no longer have to struggle with tightening or loosening of locknuts. This invention has solved all of the problems related to any and all of the known prior art and has many extra advantages which have not been incorporated into any tool to date.

The locknuts produced by various manufacturers in common use today are not standardized. They do not all have the same number of teeth, but indeed both six and eight tooth locknuts are commonly encountered. Also, the locknuts within a given size class, do not all have exactly the same size diameters at the recesses between the tabs. Nevertheless, it was desirable to make one wrench that would fit on all widely used locknuts for a given trade size. To design the gripping teeth, we thus, to look for common area of the recesses, superimposed a six tooth locknut on top of an eight tooth locknut. We found that there was a substantial area for gripping that was common to both locknuts. Thus our wrench could turn both types of locknuts! There is common allowances for free play for use by toolmakers that applies to standardized tooling. These allowances would not work for a wrench for use on non-standardized locknuts. We therefore, designed our wrench with the extra loose free play tolerance that allowed the wrench to grip recesses of locknuts with the slightly different diameters that were common.

We later discovered that if we ground off the remote one-half of the teeth, it would make finding engagement with the locknut recesses easier. In addition, square gripping teeth would result. The square gripping teeth are important because the teeth will stay engaged with the locknut recesses when the wrench is applied to a locknut at any angle. For example, if the teeth were twice as long, when a locknut was approached at a 45 degree angle, the rectangular shape of the gripping teeth would tend to rest on the top of the locknut tooth at an angle exceeding it and providing that when torque was applied the gripping tooth being forced upward and out of engagement would slide off the locknut tooth rather than bite into it to grip it. In addition to this primary function, the tool is slightly shorter, and the hook area of diametrically opposed teeth would make insertion into a pouch more difficult.

Based on the above, it is the object of this invention is to create a lightweight, easy to use, affordable conduit locknut wrench for electricians to assist them with their work. Additionally, this invention is to provide a simple, strong and very useful tool that will allow the electrician to tighten and loosen six and eight tab conduit locknuts with ease. It is also the object of this invention to provide a tool that can approach a conduit locknut from any angle or position and still be able to tighten or loosen with the correct amount of turning leverage. Additionally, it is the object of this invention to provide a wrench with a head and neck small enough and strong enough to be able to work around all the obstructions normally encountered by electricians such as other locknuts, wires and junction box tabs.

The specific nature of the invention, as well as other objects, uses, and advantages thereof, will clearly appear from the following description and from the accompanying drawing.

LIST OF ELEMENTS

9 The Lower Angle of the locknut Wrench Tooth
10 C-Shaped Head
11 Eight Tooth Locknut
12 Arcuate Arms
13 Six Tooth Locknut
14 Engagement Teeth
15 Locknut Recesses
16 Neck
17 Locknut Teeth
18 Handle

19 Square Gripping Area That Touches a Locknut Recess
20 Screw Driver Leverage Hole
22 Belt Clip Hole
32 Example of Straight-In Approach
33 Example of Lying Flat approach
34 Example of Side Approach

DETAILED DESCRIPTION OF THE INVENTION

Figure 1:
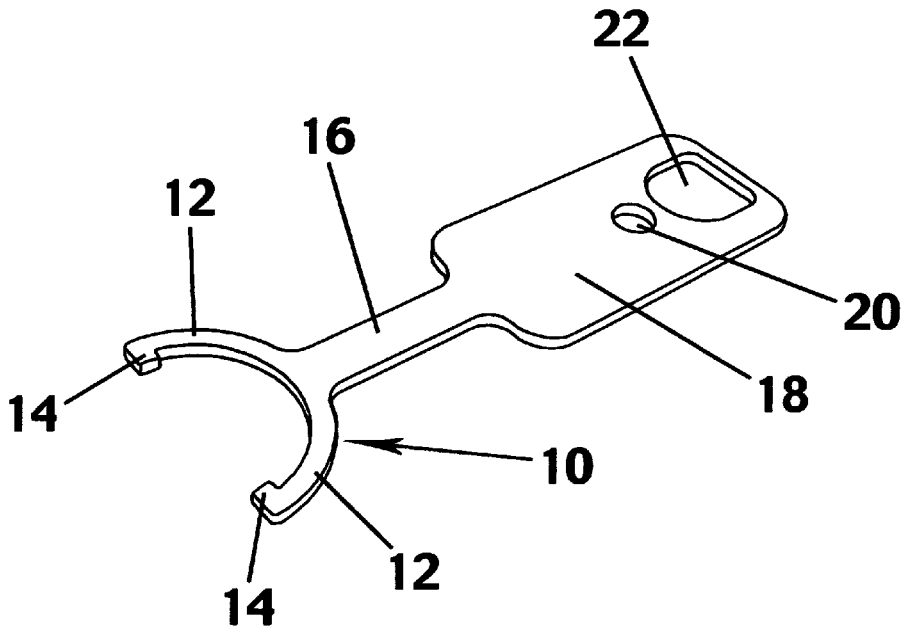
FIG. 1 shows a perspective view of the electrician's locknut wrench.
Figure 2:
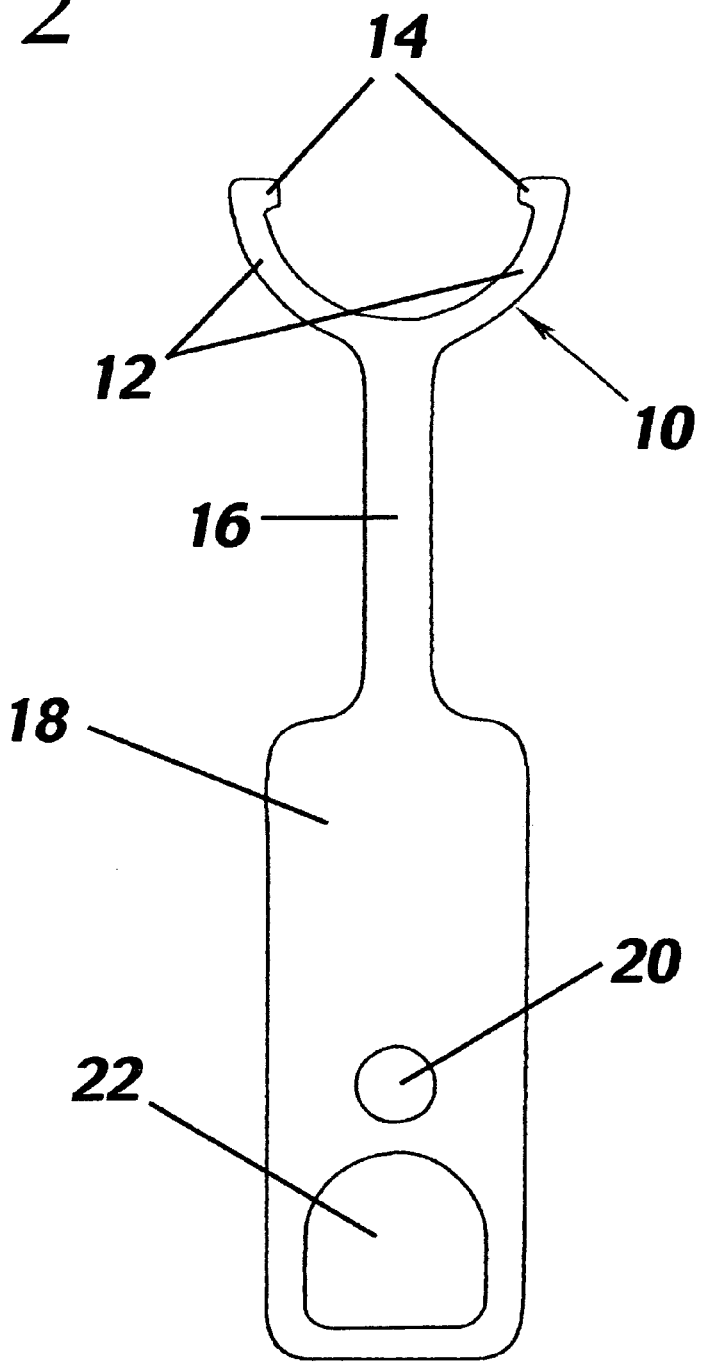
FIG. 2 shows a plan view of the electrician's locknut wrench.
Figure 3:
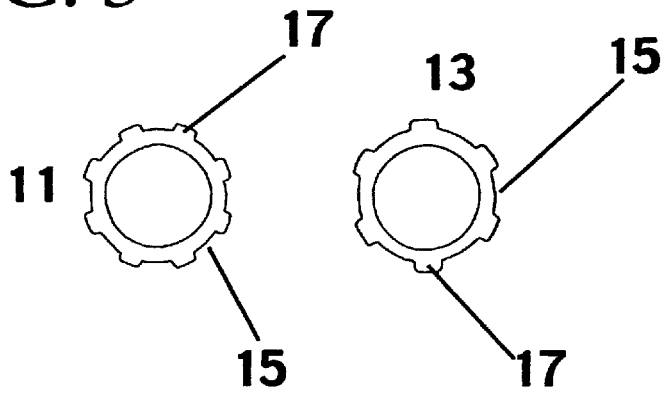
FIG. 3 shows examples of common locknuts in plan view.

As illustrated in FIG. 1 the conduit locknut wrench is comprised of three sections the C-shaped head 10, neck 16 and handle 18 cut out from one solid piece of 1010 sheet steel. The thickness of the material of the preferred embodiment is one tenth of an inch thick so the tool can be either machine punched or cut by laser or water jet. After the tool is cut out it needs to be hardened for strength, which is done to a depth of fifteen thousandths of an inch. The tool is then tumbled and plated completing the construction process.

The conduit locknut wrench can be used like any other wrench. One would simply put the head 10 of the wrench over the locknut and turn the wrench either clockwise or counter clockwise depending on whether you were tightening or loosening.

Figure 4:
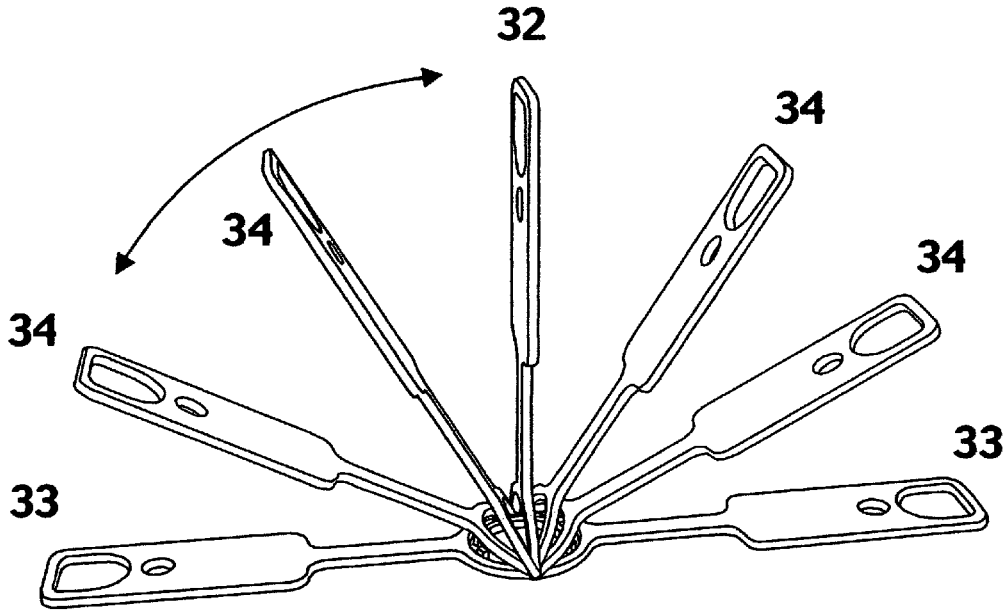
FIG. 4 a perspective view demonstrating ability to position at any angle and still turn a locknut
Figure 5:
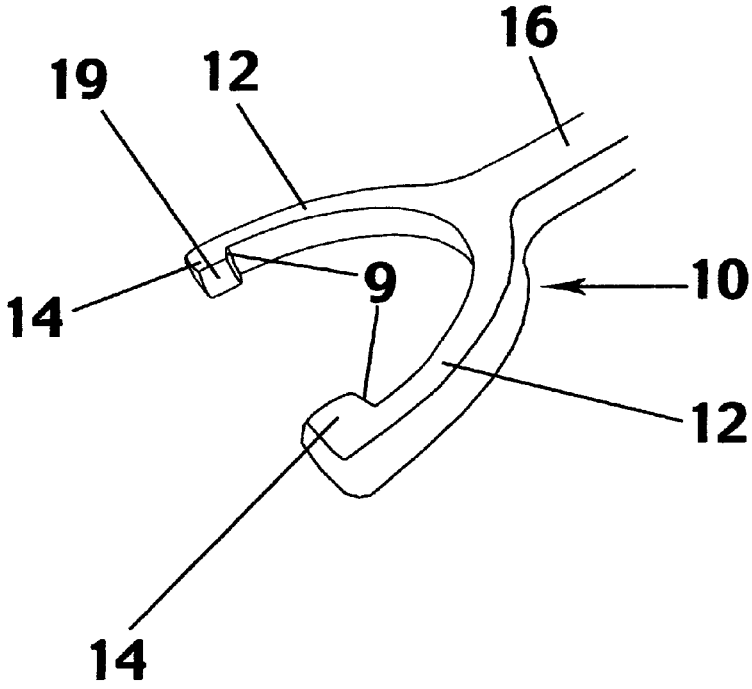
FIG. 5 shows a detailed perspective view of wrench head As an aid in correlating the terms used above with the drawings a list of elements is provided.

The C-shaped head 10 is the main component of the wrench. The head 10 consists of two arcuate arms 12 with teeth 14 for engaging recesses 15 in the conduit locknuts. The head 10 allows gripping of many different types of conduit locknuts. Six tooth locknuts 13 and eight tooth locknuts 11 are the most common and the distance between the engagement teeth 14 will allow gripping as shown in FIG. 4 from a straight in approach 32, lying flat approach 33, or side approach 34. The opening of the C-shaped head 10 is made to be slightly larger than the perimeter of the teeth 17 of a locknut to contain them before and during the turning operation.

Arcuate arms 12 are made sufficiently thin enough to fit into tight recesses encountered often during engagement of teeth 14 yet strong enough to provide sufficient rigidity during tightening and loosening so that they don't bend or warp when encountering the expected torque demands of the wrench. The arcuate arms 12 are also designed to be of sufficient strength not to distort during a straight in or above 45 degree angle approach i.e. when the wrench is perpendicular to the locknut. The arms 12 inner diameter are of a size to sufficiently envelope the locknut and to provide a certain amount of free play and allowance for locknut variations. Thinness of arcuate arms 12 and properties of the metal after hardening allow for a certain springiness to the head 10 allowing diversion of teeth 14 slightly (and their return) when gripping a locknut that is larger than the standard. The thinness of the arms 12 also helps with good visibility during engagement of the locknut. The outer corners of the arcuate arms 12 are slightly rounded to safeguard wires but not so much as to compromise the support area during the straight in approach turning. The slightly rounded corners also prevent hooking or biting during insertion into a pouch or when worn on a belt clip.

The teeth 14 of the C-shaped head 10 are made to grip locknuts sufficiently loose and are designed to except the differences in the present occurring six and eight tab locknuts. The teeth 14 oppose each other and extend inwardly about the depth of a locknut tooth. The dimension of these teeth is critical in making the tool effective. The wrench itself is as thick as the teeth 14 are wide at the gripping area 19 that touches the inner valley of the locknut forming a square 19. This is important with regard to the unique and useful straight in approach ability of the tool. The teeth 14 are located slightly off access by removal of the remote one-half of what would be diametrically opposed teeth. This reduced width provides free play and easy alignment with locknut recesses and shortens the awkwardness and hook area for easier insertion into J-boxes or into a tool pouch. The angle 9 of the lower side of the teeth 14 also adds support when turning a locknut.

The top of the neck 16 is shaped with curvature slightly diminished to provide additional leverage and support for the necessarily thin arcuate arms 12. Neck 16 is long enough to extend to most remotely encountered locknut locations in modern equipment. It's length is precisely determined for this purpose. The longer neck 16 contributes to a longer turning radius of the wrench. The neck 16 width is sufficiently thin to permit extra turning radius and repositioning of the wrench without hindrance from junction box edges or other cramped working conditions. The thin width of the neck 16 is only enough to provide support and strength needed during a turning operation. Yet not too much strength to allow breakage of the locknut with ease. The neck 16 is also sufficiently thin to allow the user to have sufficient feedback during engagement with the nut that a thicker heavier wrench might not provide. The bottom of the neck 16 is shaped with curvature slightly increasing into the handle 18 to provide additional leverage and support.

The rounded top corners of the handle 18 supply addition leverage verses non rounded corners.

The handle 18 is designed to be long enough to fit comfortably in the average persons hand and wide enough to provide the correct amount of leverage to open even the tightest locknuts. The widening of the handle 18 begins far enough down to allow access to the deepest located locknuts yet is thick enough and hard enough to not bend or give way with the forces encountered during a straight in (or perpendicular) approach. The handle 18 is sufficiently wide enough to allow relative ease of leverage when approaching a locknut in perpendicular fashion (straight in approach). This feature is extremely useful. For example, agricultural and landscape boxes are often deep and full of wires and the locknuts are usually corroded or rusted into place at the bottom of the junction box. The rounded bottom corners of the handle 18 feel better in your hand when gripping.

The screwdriver leverage hole 20 may be used when additional leverage is needed to break loose a tight conduit locknut. The screwdriver is inserted into the hole 20 and then gripped on either side, for more leverage during turning.

The belt clip cut out 22 is used to clip the tool onto your tool pouch or belt.

Portions of the handle may or may not be dipped in insulating type material like rubber or plastic. As to the matter of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, material shape form and function and manner of operation and use are deemed readily apparent and obvious to one skilled in the art, and all equivalent relationships to those illustrated in the drawings and described in the specification are intended to be encompasses by the present invention.

Therefore, the for going is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim as our invention:

1. A wrench for gripping electrical locknuts, having a) a handle with a neck portion and a grip portion, b) a C-shaped head attached to said handle for engaging said electrical locknuts, c) said C-shaped head having a central portion, d) two arcuate arms integral with and extending from said central portion from said C-shaped head, e) said arcuate arms defining a gap having a width to accept said electrical locknuts of a particular diameter, wherein said arcuate arms ending in gripping teeth that extend inwardly in opposition to each other and said teeth having a square area perpendicular to a plane of said handle and a side angularly attached to said square area being perpendicular to the square area and said plane of said handle.

2. The wrench of claim 1, wherein said handle has an aperture.

3. The wrench of claim 1 wherein said handle has a plurality of apertures.

4. The wrench of claim 1 wherein said gripping teeth are offset diametrically.

* * * * *